US011284733B2

(12) United States Patent
Yu

(10) Patent No.: US 11,284,733 B2
(45) Date of Patent: Mar. 29, 2022

(54) HOOK STRUCTURE FOR POSITIONING A CURTAIN

(71) Applicant: ARLINEA INDUSTRIES CO., Taoyuan (TW)

(72) Inventor: Yu-Heng Yu, Taoyuan (TW)

(73) Assignee: ARLINEA INDUSTRIES CO., Taoyuan (TW)

( * ) Notice: Subject to any disclaimer, the term of this patent is extended or adjusted under 35 U.S.C. 154(b) by 413 days.

(21) Appl. No.: 16/441,888

(22) Filed: Jun. 14, 2019

(65) Prior Publication Data

US 2020/0390263 A1 Dec. 17, 2020

(51) Int. Cl.
*A47H 3/04* (2006.01)
*A47H 13/04* (2006.01)

(52) U.S. Cl.
CPC ..... *A47H 13/04* (2013.01)

(58) Field of Classification Search
CPC .... A47H 13/04; A47H 13/14; E05D 15/0621; F16B 2/24; F16B 2/248; F16G 11/02; F16G 11/046
USPC ..... 16/93 r, 93 d, 87 r
See application file for complete search history.

(56) References Cited

U.S. PATENT DOCUMENTS 613,543 A * 11/1898 Wibur ..... A47H 15/04 16/87.4 R
1,855,036 A * 4/1932 Vroom ..... A47H 11/02 160/345
2,641,315 A * 6/1953 Martens ..... A47H 13/14 160/348
2,692,382 A * 10/1954 Edwin ..... A47H 13/14 227/124
3,141,219 A * 7/1964 Shears ..... B42F 13/12 24/458
3,347,360 A * 10/1967 Saltz ..... B65D 73/02 206/338
3,370,316 A * 2/1968 Stieler ..... A47H 13/04 16/87.2
3,688,341 A * 9/1972 Peckham ..... A47H 15/00 16/93 D
3,737,943 A * 6/1973 Store ..... A47H 13/04 16/87.2
3,992,749 A * 11/1976 Getchell ..... A47H 13/04 16/93 D
4,880,253 A * 11/1989 Nishimura ..... B60R 22/06 280/804
D386,390 S * 11/1997 Ebarb ..... D8/370
D465,996 S * 11/2002 Suero, Jr. ..... D8/367
(Continued)

*Primary Examiner* — Emily M Morgan
(74) *Attorney, Agent, or Firm* — Chun-Ming Shih; HDLS IPR Services

(57) ABSTRACT

A hook structure for positioning a curtain and combining a curtain fabric with connecting portions includes hooks and a rope fastening module. Each hook has a hook body, an elastic hook portion extending from the hook body, and a carrier connected to the hook body. A passing-through space between the elastic hook portion and the hook body is provided for inserting the connecting portion, and the carrier has an engaging space. The rope fastening module includes fasteners and a rope connected to the fasteners, each fastener is embedded into the engaging space, so that the distance between two adjacent fasteners of the curtain fabric is maintained by the rope, and the curtain fabric is maintained in a uniform and regular wavy form.

9 Claims, 6 Drawing Sheets

(56) References Cited

U.S. PATENT DOCUMENTS

| | | | | | |
|---|---|---|---|---|---|
| D489,249 | S | * | 5/2004 | Moore | D8/367 |
| D536,953 | S | * | 2/2007 | Schmidt | D8/367 |
| 7,748,673 | B2 | * | 7/2010 | Barrese | A47H 13/02 248/215 |
| D630,088 | S | * | 1/2011 | Kim | D8/367 |

* cited by examiner

HOOK STRUCTURE FOR POSITIONING A CURTAIN

BACKGROUND OF THE INVENTION

1. Technical Field

The technical field relates to curtain hooks, and more particularly to a hook structure for positioning a curtain.

2. Description of Related Art

Curtain is generally used to cover doors and windows to achieve the effects of providing an aesthetic look, shading the sun, and adjusting the intensity of light. In general, a conventional curtain structure comprises a curtain rod, a plurality of hanging rings, and a curtain fabric, and the hanging rings are spaced from one another and sheathed on the curtain rod, so that the hanging rings can be moved along the curtain rod. In addition, the hook is arranged at the lower end of the hanging ring lower end for hanging the curtain fabric onto the hanging rings by the hooks. Therefore, the curtain fabric can be drawn open or closed along the curtain rod through the hanging rings.

However, the distance between the hanging rings of the conventional curtain structure is not fixed, so that when the curtain fabric is drawn open or closed, the curtain fabric will be in an irregular wavy form because of the unequal distances between two adjacent hanging rings, and the curtain fabric may even produces a different curvature or a different pleat depth because of the mutual pushing of the curtain fabric, and these will affect the aesthetic look of the curtain.

In view of the aforementioned drawbacks of the prior art, the discloser of this disclosure based on years of experience in the related industry to conduct extensive research and experiment, and provided a feasible solution to overcome the drawbacks of the prior art.

SUMMARY OF THE INVENTION

Therefore, it is a primary object of this disclosure to overcome the drawbacks of the prior art by providing a hook structure for positioning a curtain, so that the distance of the curtain fabric can be maintained by the rope fastening module to keep the curtain fabric in a uniform and regular wavy form.

To achieve the aforementioned and other objectives, this disclosure provides a hook structure for positioning a curtain and combining with a curtain fabric, and the curtain fabric has a plurality of connecting portions, and the hook structure comprises a plurality of hooks and a rope fastening module. Each hook comprises a hook body, an elastic hook portion extending from the hook body and a carrier coupled to the hook body, and a passing-through space is defined between the elastic hook portion and the hook body for inserting the connecting portion, and the carrier has an engaging space. The rope fastening module comprises a plurality of fasteners and a rope serially coupled to the fastener, and each fastener is embedded into the engaging space, so that the distance between two adjacent fasteners of the curtain fabric can be maintained.

Compared with the prior art, the hook structure for positioning a curtain of this disclosure is fixed to the curtain fabric by the hooks combined with the fasteners, so that when the curtain fabric is moved, the curtain fabric is limited by the rope to maintain the distance of the curtain fabric in order to keep the curtain fabric in a uniform and regular wavy form, so as to maintain the aesthetic look of the curtain fabric and improve the practicality of this disclosure.

DESCRIPTION OF THE PREFERRED EMBODIMENTS

Figure 2:
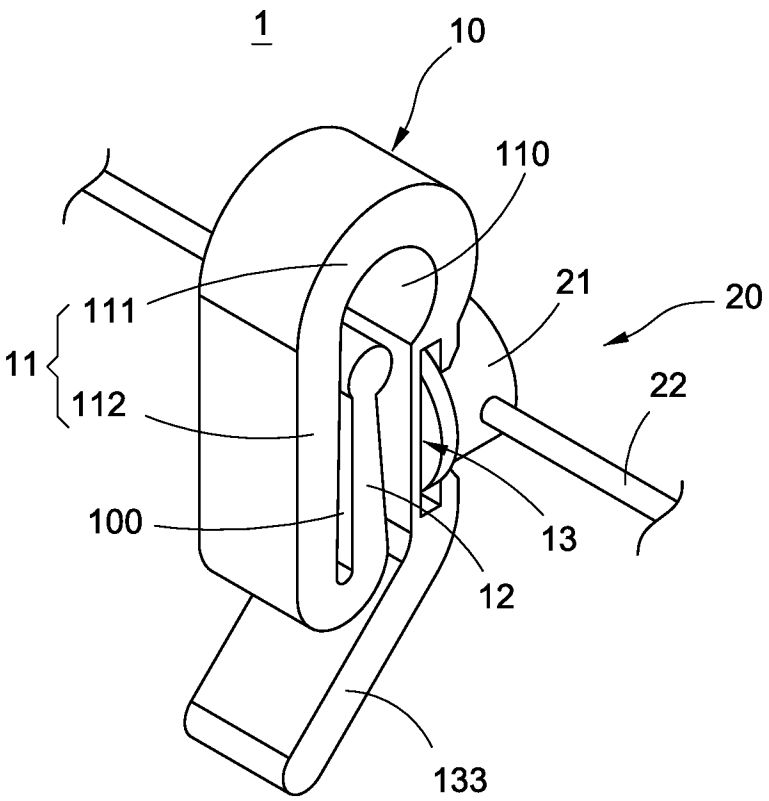
FIGS. 1 and 2 are perspective views of a hook structure for positioning a curtain in accordance with this disclosure.
Figure 1:
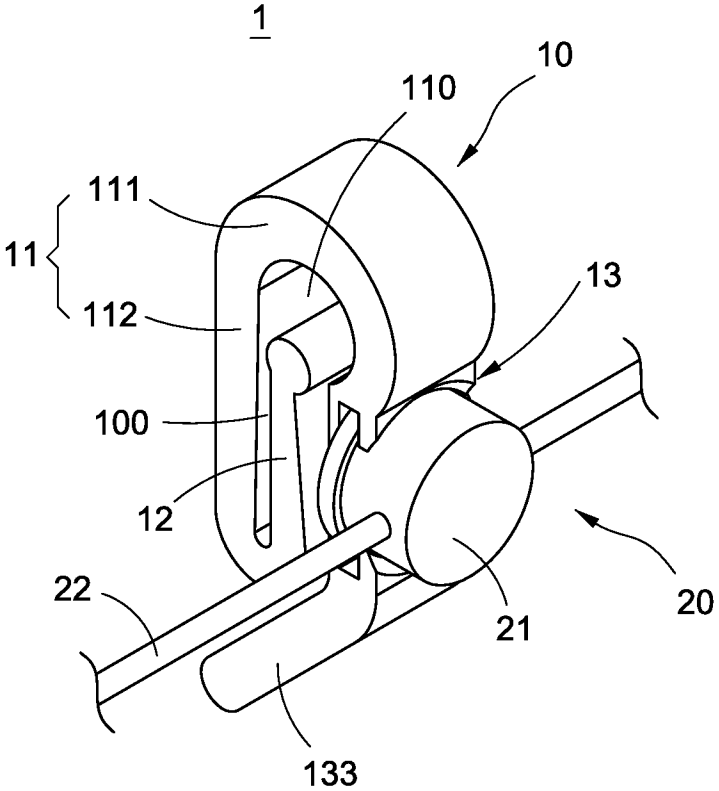
Figure 3:
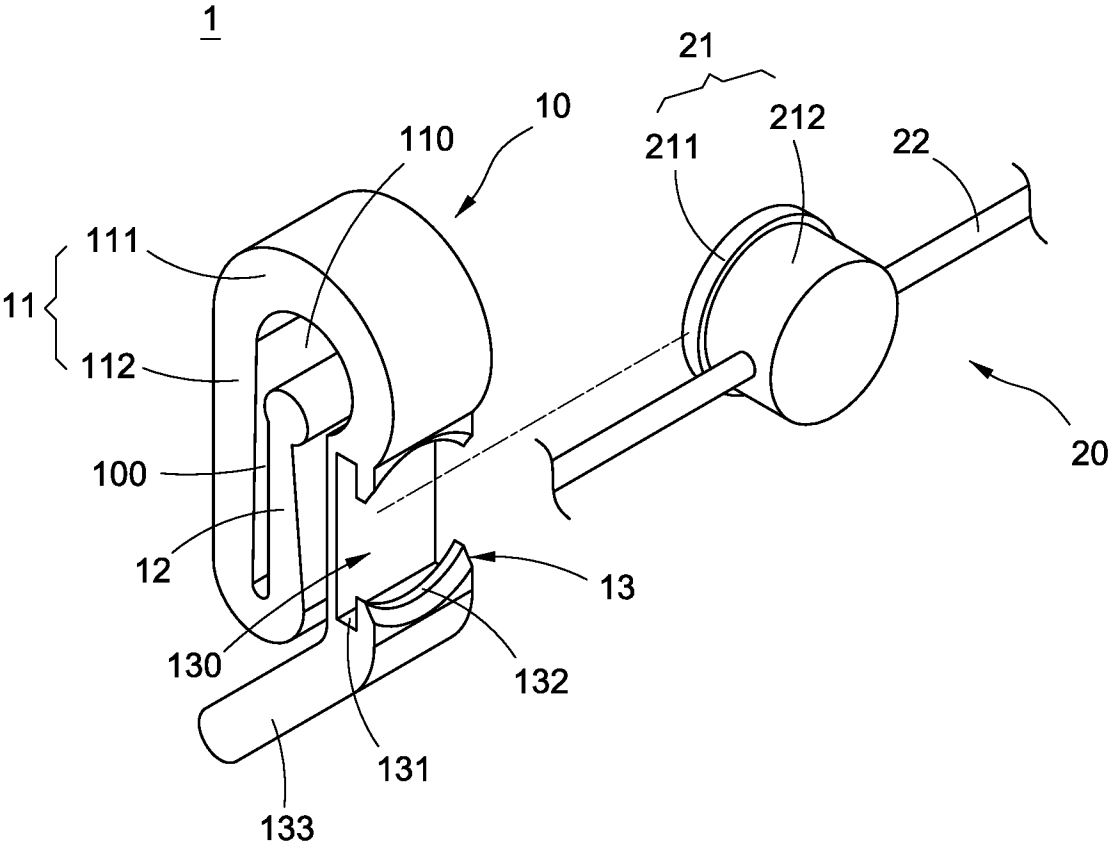
FIG. 3 is a schematic view of a detached hook structure for positioning a curtain in accordance with this disclosure.

The technical contents of this disclosure will become apparent with the detailed description of preferred embodiments accompanied with the illustration of related drawings as follows. It is intended that the embodiments and drawings disclosed herein are to be considered illustrative rather than restrictive.

With reference to FIGS. 1 to 4 for the two perspective views, the schematic view of the detached structure, and the cross-sectional view of a hook structure for positioning a curtain in accordance with this disclosure respectively, the hook structure 1 comprises a plurality of hooks 10 and a rope fastening module 20. The rope fastening module 20 is combined with the hooks 10 to constitute the hook structure for positioning a curtain 1. The hook structure 1 will be described in details as follows.

Each hook 10 comprises a hook body 11, an elastic hook portion 12 extending from the hook body 11, and a carrier 13 coupled to the hook body 11. A passing-through space 100 is defined between the elastic hook portion 12 and the hook body 11, and the carrier 13 has an engaging space 130. In addition, the elastic hook portion 12 is disposed between the hook body 11 and the carrier 13.

Specifically, the hook body 11 includes a ring-shaped section 111 and a connection section 112, and the elastic hook portion 12 bends and extends from the connection section 112, and the carrier 13 is coupled to an end of the ring-shaped section 111. Specifically, the ring-shaped section 111 has a through hole 110 disposed above the elastic hook portion 12.

The rope fastening module 20 comprises a plurality of fasteners 21 and a rope 22 serially coupled to the fasteners 21. In this embodiment, the fasteners 21 are plastic parts, and the rope 22 is a nylon rope, but this disclosure is not limited to such arrangements only. Each fastener 21 is embedded into the engaging space 130 of the carrier 13. Preferably, the fasteners 21 and the rope 22 are integrally formed into a single piece. Of course, the fasteners 21 and the rope 22 may also be detached and then combined with each other again.

The carrier 13 comprises a slot 131 and a support plate 132 disposed on a side of the slot 131, and a side of the fastener 21 is forced into the slot 131 and the other side of the fastener 21 abuts against the support plate 132. Preferably, the carrier 13 further comprises a beveled plate 133 extending obliquely from the bottom of the slot 131 in a direction towards the elastic hook portion 12.

In an embodiment of this disclosure, the fastener 21 of the rope fastening module 20 includes an insert plate 211 and a base 212 coupled to the insert plate 211, and the insert plate 211 is passed and installed into the slot 131 of the carrier 13, and the base 212 is coupled to the rope 22. Preferably, the insert plate 211 and the base 212 are integrally formed into a single piece.

Figure 5:
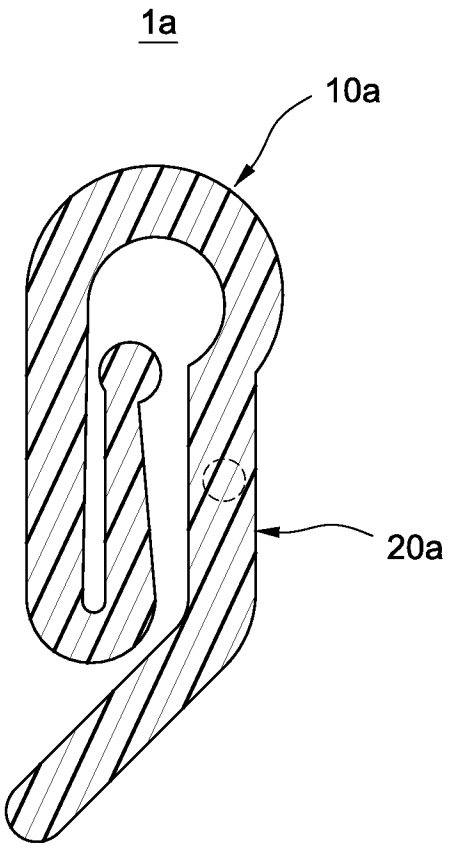
FIG. 5 is a cross-sectional view of a hook structure for positioning a curtain in accordance with another implementation mode of this disclosure.
Figure 4:
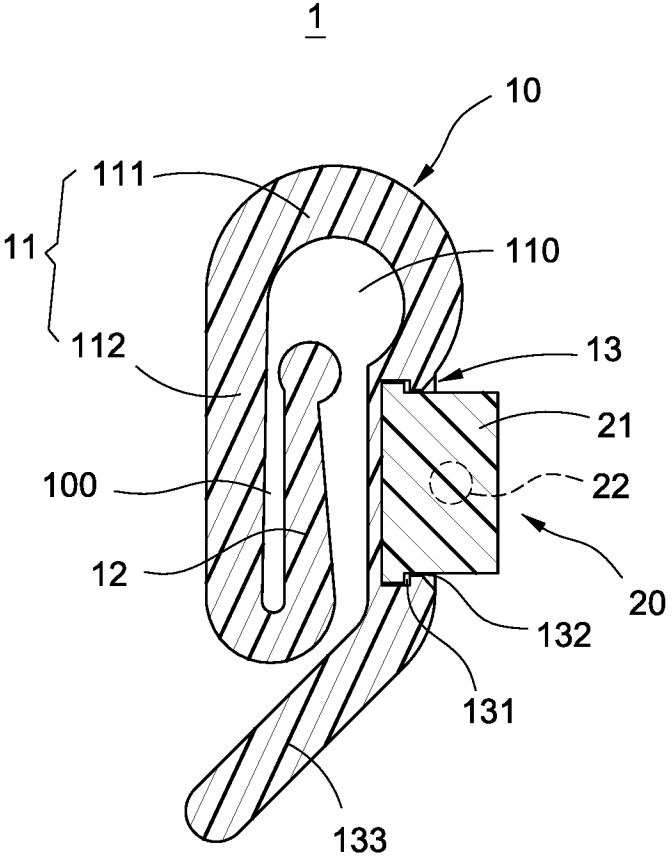
FIG. 4 is a cross-sectional view of a hook structure for positioning a curtain in accordance with this disclosure.

With reference to FIG. 5 for a hook structure for positioning a curtain in accordance with another implementation mode of this disclosure, the hook structure 1*a* comprises a plurality of hooks 10*a* and a rope fastening module 20*a*. The difference between this embodiment and the one illustrated by FIG. 4 resides on that the hooks 10*a* and the rope fastening module 20*a* are integrally formed as a single piece.

Figure 6:
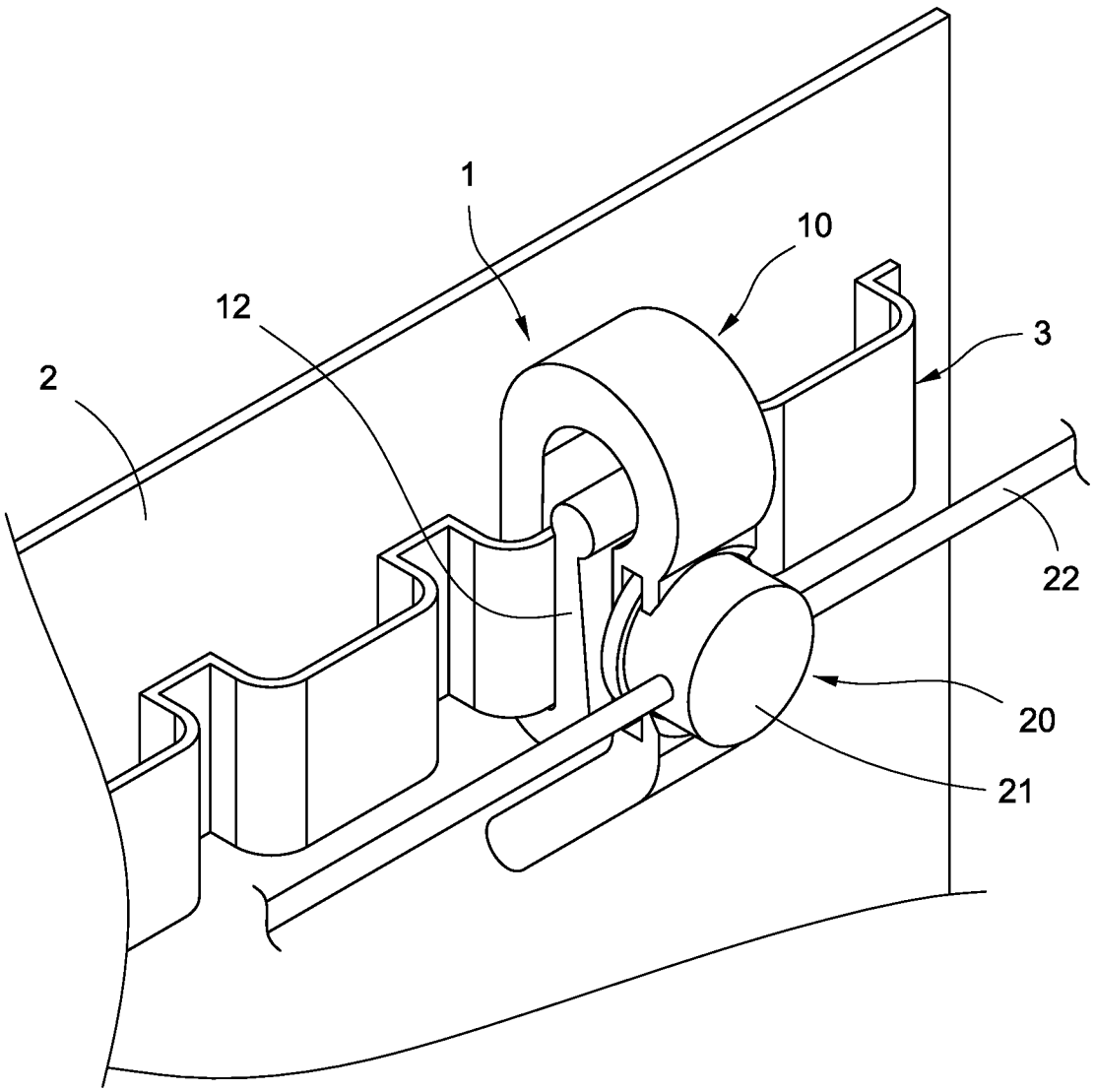
FIGS. 6 and 7 are a perspective view and a schematic view showing two using modes of a hook structure for positioning a curtain in accordance with this disclosure respectively.
Figure 7:
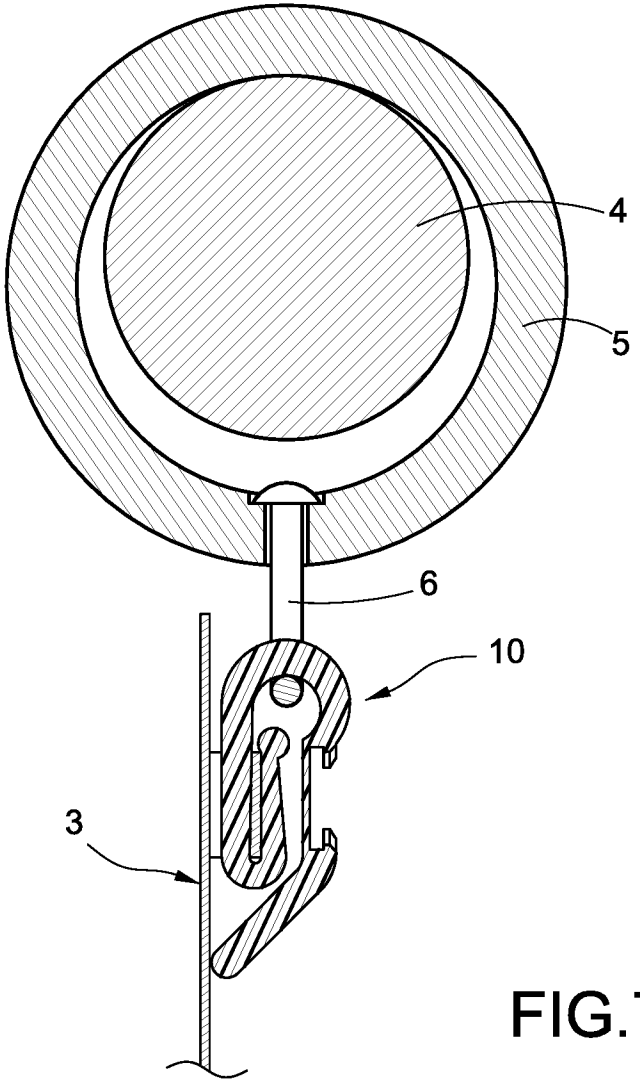

With reference to FIGS. 6 and 7 for two using mode of a hook structure for positioning a curtain of this disclosure, the hook structure for positioning a curtain 1 as shown in FIG. 6 is combined with a curtain fabric 2, and the curtain fabric 2 has a plurality of connecting portion 3. In this embodiment, the connecting portions 3 are woven hooks, but this disclosure is not limited to such arrangement only.

During the use of the hook structure 1, the hook structure 1 is fixed onto the curtain fabric 2 through the connecting portions 3. Specifically, the plurality of hooks 10 are spaced from one another and disposed on the connecting portions 3 respectively. In addition, the quantity of hooks 10, the distance between two adjacent hooks 10, and the length of the rope fastening module 20 may be adjusted according to the size and actual using requirements of the curtain fabric 2. In this embodiment, after the hook 10 combined with the fastener 21 is hooked and attached to the woven hook of curtain fabric 2, the distance between two adjacent fasteners 21 of the curtain fabric 2 can be maintained by the rope 22, so as to keep the curtain fabric 2 in a uniform and regular wavy form.

It is noteworthy that the hook 10 of the hook structure 1 of this disclosure may be used alone. With reference to FIG. 7 for its actual use, the curtain structure further comprises a curtain rod 4 and a plurality of hanging rings 5, and the hanging rings 5 are spaced from one another and sheathed on the curtain rod 4. In addition, the hooks 10 are combined with an upper edge of the curtain fabric 2, and the hook 10 is combined with the bottom of the hanging ring 5 by a ring-shaped member 6, so that the curtain fabric 2 can be hung and attached to the bottom of the curtain rod 4.

Figure 8:
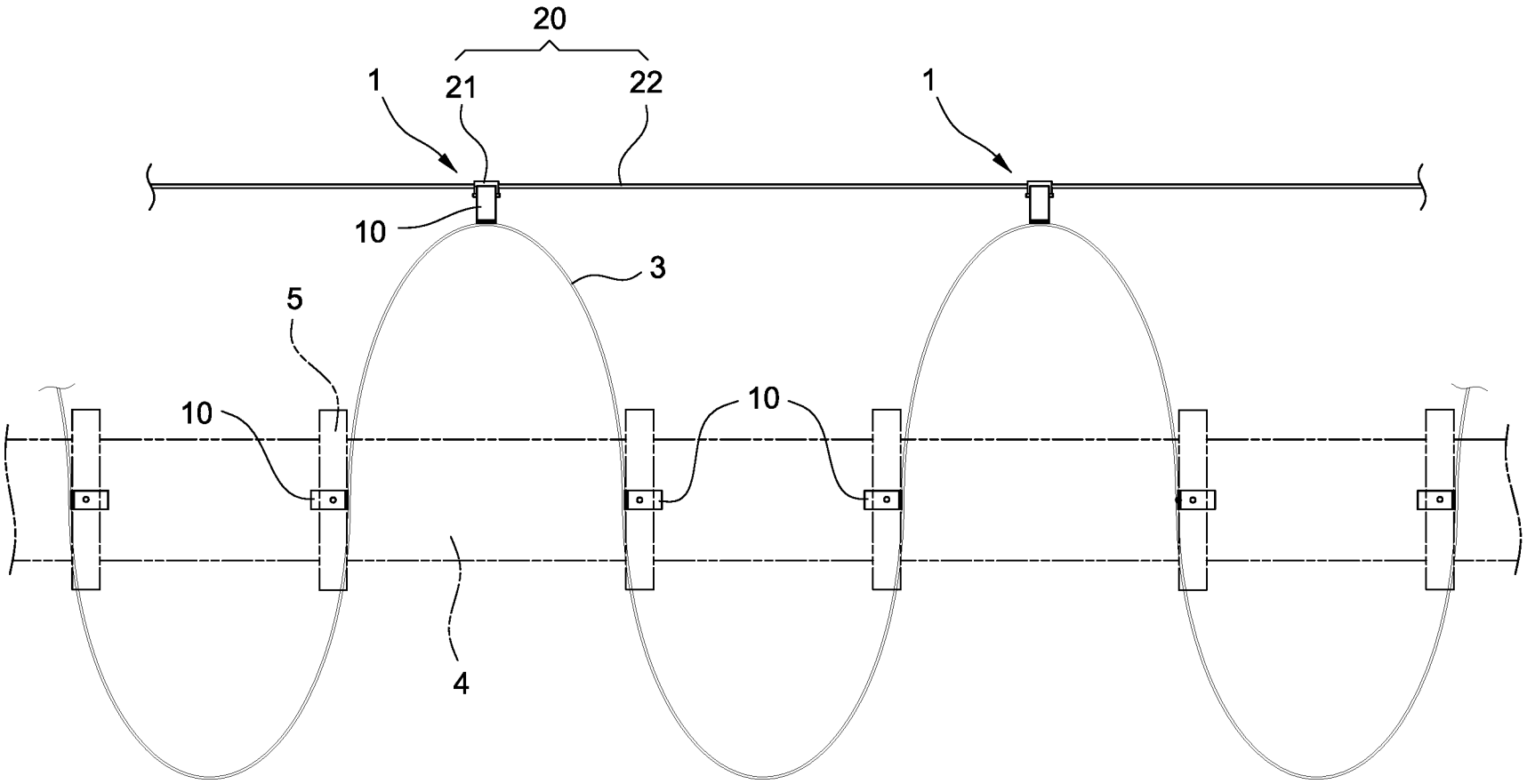
FIG. 8 is a bottom view of a hook structure for positioning a curtain during use in accordance with this disclosure.

With reference to FIG. 8 for a bottom view of a hook structure for positioning a curtain in accordance with an embodiment of this disclosure, the curtain fabric 2 is hung and attached to the curtain rod 4 by the method of using a single hook 10 as shown in FIG. 7. The rope fastening module 20 is combined with a side of the curtain fabric 2 by the combining method as shown in FIG. 6. Therefore, when the hanging rings 5 is pulled to move the curtain fabric 2, the curtain fabric 2 is limited by the rope 22 to limit the distance between two adjacent fasteners 21 of the curtain fabric 2, so as to keep the curtain fabric 2 in a uniform and regular wavy form.

While this disclosure has been described by means of specific embodiments, numerous modifications and variations could be made thereto by those skilled in the art without departing from the scope and spirit of this disclosure set forth in the claims.

What is claimed is:

1. A hook structure for positioning a curtain having a plurality of connecting portions, and the hook structure comprising:

a plurality of hooks, spaced from one another and disposed on the connecting portions respectively, each hook including a hook body, an elastic hook portion extending from one distal end of the hook body and a carrier coupled to another distal end of the hook body, the hook body comprising a ring-shaped section and a straight connection section, the elastic hook portion bending and extending from the straight connection section, and the carrier being coupled to an end of the ring-shaped section, and a passing-through space being defined between the elastic hook portion and the hook body for inserting the connecting portion, and the carrier having an engaging space; and a rope fastening module, including a plurality of fasteners and a rope serially coupled to the fasteners, and each fastener being embedded into the engaging space, so that a distance between two adjacent fasteners of a curtain fabric is maintained by the rope.

2. The hook structure for positioning a curtain according to claim 1, wherein the ring-shaped section has a through hole disposed above the elastic hook portion.

3. The hook structure for positioning a curtain according to claim 1, wherein the elastic hook portion is disposed between the hook body and the carrier.

4. The hook structure for positioning a curtain according to claim 1, wherein the carrier comprises a slot and a support plate disposed on a side of the slot, and a side of the fastener is forced into the slot and the other side of the fastener abuts against the support plate.

5. The hook structure for positioning a curtain according to claim 4, wherein the carrier further comprises a beveled plate extending obliquely from the bottom of the slot and in a direction towards the elastic hook portion.

6. The hook structure for positioning a curtain according to claim 4, wherein the fastener comprises an insert plate and a base coupled to the insert plate, the insert plate is passed into the slot, and the base is coupled with the rope.

7. The hook structure for positioning a curtain according to claim 6, wherein the insert plate and the base are integrally formed into a single piece.

8. The hook structure for positioning a curtain according to claim 1, wherein the fasteners and the rope are integrally formed into a single piece.

9. The hook structure for positioning a curtain according to claim 1, wherein the hooks and the rope fastening module are integrally formed into a single piece.

* * * * *